US006416344B2

(12) United States Patent
Okayasu et al.

(10) Patent No.: US 6,416,344 B2
(45) Date of Patent: Jul. 9, 2002

(54) CONNECTOR AND A METHOD FOR DETACHING HOUSINGS THEREOF

(75) Inventors: Yasushi Okayasu; Kiyofumi Ichida; Yasumitsu Makita, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/855,787

(22) Filed: May 15, 2001

(30) Foreign Application Priority Data

Jun. 8, 2000 (JP) ..... 2000-172039

(51) Int. Cl.[7] ..... H01R 13/627
(52) U.S. Cl. ..... 439/352; 439/595
(58) Field of Search ..... 439/595, 352

(56) References Cited

U.S. PATENT DOCUMENTS 4,802,869 A 2/1989 Maue ..... 439/587

FOREIGN PATENT DOCUMENTS

EP 0 768 732 4/1997
EP 0 877 447 11/1998

*Primary Examiner*—Gary F. Paumen
*Assistant Examiner*—Ann McCamey
(74) *Attorney, Agent, or Firm*—Anthony J. Casella; Gerald E. Hespos

(57) ABSTRACT

A male housing (10) has a receptacle (12) that surrounds a tower (11) provided with cavities (13). A retainer (20) is mounted on the front of the tower (11). The bottom surface of the retainer (20) has a longitudinal groove (41) with a catch surface (42), and a jig insertion groove (40) is formed in a bulging portion (22) at the bottom end of the rear surface of the retainer (20). An upwardly sloped guide surface (51) is formed in the bottom surface of the receptacle (12) and aligns with the jig insertion groove (40). A jig (45) having a hook (47) at one end is provided to detach the retainer (20). The hook (47) of the jig (45) is inserted through the jig insertion groove (40) and moves up along the guide surface (51) to enter the longitudinal groove (41) and face the catch surface (42). The jig (45) then is pulled back to detach the retainer (20).

3 Claims, 7 Drawing Sheets

CONNECTOR AND A METHOD FOR DETACHING HOUSINGS THEREOF

BACKGROUND OF THE INVENTION

1. Field of the Invention

The invention relates to a connector in which two housings are connected by inserting one housing into a mounting recess of the other housing. The invention also relates to a method for separating two such housings.

2. Description of the Related Art

A known watertight connector is shown in Japanese Examined Patent Publication No. 64-60980, and comprises a connector housing with cavities and a receptacle around the cavities. The connector housing also has resin locks adjacent the cavities. Terminal fittings are inserted into the cavities from behind and elastically deform the resin locks during insertion. However, the resin locks return elastically toward their original alignment when the terminal fittings reach their proper insertion positions. Accordingly, the resin locks achieve primary locking of the terminal fittings. A retainer then is inserted into a front opening of the receptacle and is mounted on front surfaces of the cavities. The retainer projects into deformation permitting spaces of the resin locks to restrict inadvertent deformations of the resin locks. As a result, the terminal fittings are locked doubly.

The retainer of the above-described connector may have to be removed periodically for maintenance. However, the retainer is mounted to the back of the receptacle. As a result, a special jig must be used to detach the retainer from the connector. The jig is a long narrow member with a hook at its leading end. The jig is inserted through the opening of the receptacle along an insertion path between the outer surface of the retainer and the inner surface of the receptacle. The hook at the leading end of the jig engages a catch on the retainer and then is pulled back to detach the retainer.

The engagement of the jig with the catch cannot be seen from the outside. Thus, the jig is engaged with the catch almost by intuition, and generally by moving the jig many times. This may damage and/or deform the inner circumferential surface of the receptacle and the retainer while the jig is being moved, and such damage and/or deformation may impair the ability of the connector to seal with a mating connector.

The present invention was developed in view of the above situation, and an object of the invention is to enable a second housing to be detached smoothly by a jig.

SUMMARY OF THE INVENTION

The invention is directed to a connector that comprises a first housing formed with a mounting recess and at least one second housing that can be inserted at least partly into the mounting recess. The connector further comprises a locking mechanism for locking the second housing in the mounting recess. The second housing can be detached from the mounting recess by inserting a jig into the mounting recess, engaging the jig with a catch in the second housing, and then pulling the jig. A jig guide is provided on an insertion path of the jig in the mounting recess, and guides the jig to a position where it is engaged with the catch of the second housing. The second housing then can be detached by pulling the jig.

The jig guide enables the jig engaging operation and the second housing detaching operation to be performed smoothly, and members around the insertion path are not scratched or deformed.

The first housing preferably has a receptacle substantially around one or more cavities that accommodate terminal fittings. The first housing further comprises locking portions for locking the terminal fittings in the cavities. The second housing preferably is a front retainer that mounts on or in the cavities for doubly locking the terminal fittings. More particularly, the second housing may mount through an opening of the receptacle and on the fronts of the cavities. Additionally, part of the second housing may enter deformation permitting spaces of the locks. The front retainer can be detached smoothly by the jig, and without scratching either the receptacle or the retainer.

A temporarily holding means is provided between the retainer and the connector housing to hold the front retainer in a position that is retracted from the deformation permitting space s of the locking portions. The terminal fittings can be inserted into the cavities and withdrawn from the cavities when the retainer is in the retraced position. Thus, the retainer can be mounted partly in the connector housing before the terminal fittings are inserted to achieve convenient handling of the connector.

The second housing may comprise a jig insertion groove in an alignment that ensures the jig will interact with the catch.

The first housing may also comprise a second housing guide for guiding the second housing during insertion into the first housing. The jig guide preferably is substantially continuous with the second housing guide.

The catch of the second housing preferably interacts with a hook of the jig, in a direction substantially opposed to an insertion direction of the jig into the connector.

The locking mechanism may be released or unlocked by the interaction of the jig with the catch of the second housing, thereby allowing the second housing to be detached from the first housing.

The invention also is directed to a method for separating at least two engaged housings of a connector. A first housing of the connector is formed with a mounting recess, and at least one second housing can be inserted at least partly into the mounting recess. The method comprises inserting a jig into the mounting recess for detaching the second housing, engaging the jig with a catch in the second housing and pulling the jig. A jig guide guides the jig to a position where it engages the catch of the second housing. The jig guide is provided on an insertion path of the jig in the mounting recess.

The invention also is directed to a locking mechanism for locking the second housing with the first housing. The locking mechanism can be unlocked by the interaction and pulling of the jig with the catch of the second housing.

These and other objects, features and advantages of the present invention will become apparent upon reading of the following detailed description of preferred embodiments and accompanying drawings.

DETAILED DESCRIPTION OF THE PREFERRED EMBODIMENT

A connector according to the invention comprises a male housing 10, male terminal fittings 1 accommodated in the male housing 10, and a front retainer 20 for doubly locking the male terminal fittings 1.

Figure 3:
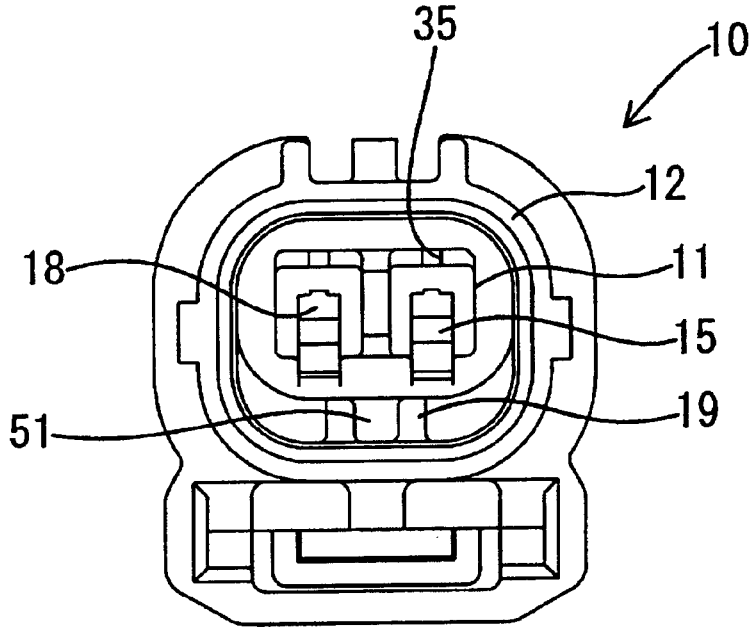
FIG. 3 is a front view of a male housing as a preferred first housing.

The male housing 10 is formed integrally or unitarily of synthetic resin, and comprises a tower 11 and a receptacle 12 that substantially surrounds a front half of the tower 11. The front half of the tower 11 is separated laterally into two sections, as shown in FIG. 3. Cavities 13 are formed substantially side-by-side in the two separated sections of the tower 12 and are dimensioned to receive the terminal fittings 1. A lock 15 is formed in the bottom wall of each cavity 13 and is elastically deformable toward a deformation permitting space 16 below the respective lock 15. Each lock 15 can be engaged with a jaw 4 on the terminal fitting 1 inserted in the respective cavity 13. An opening is formed in the bottom wall of each cavity 13 before the lock 15.

Figure 1:
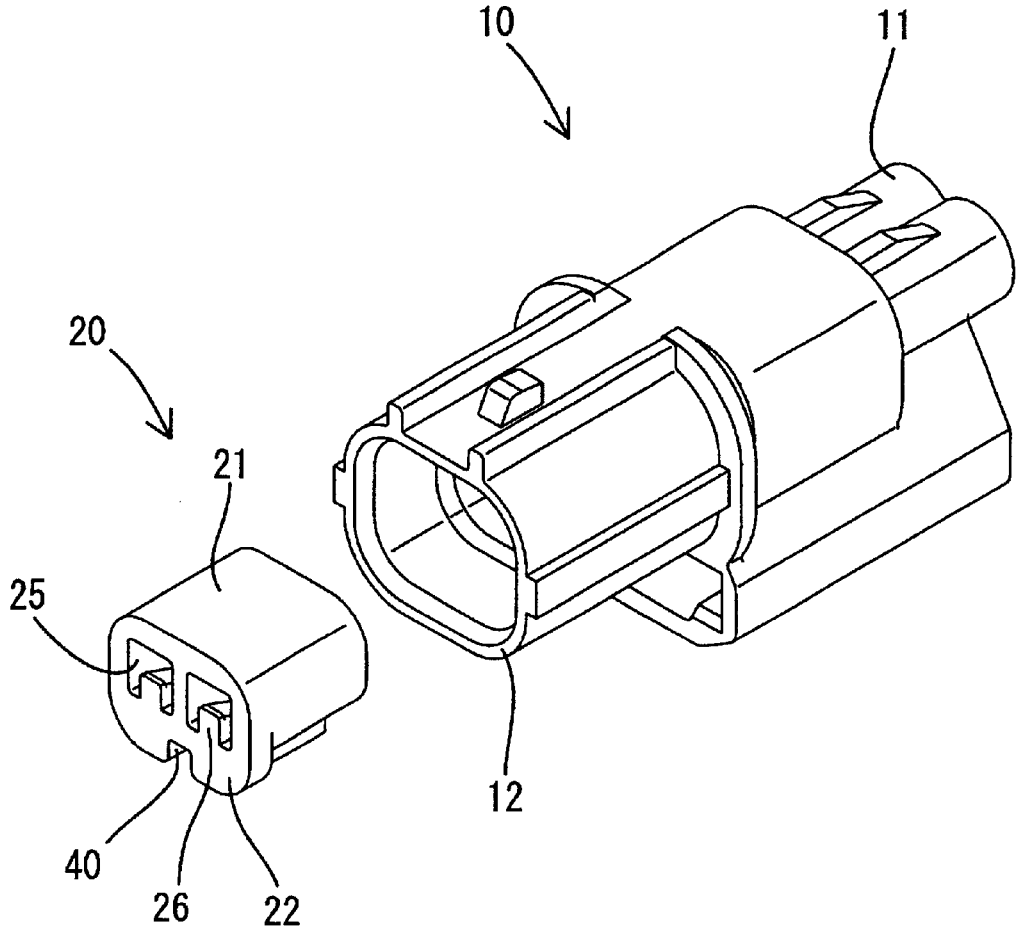
FIG. 1 is an exploded perspective view of a connector according to one preferred embodiment of the invention.
Figure 2:
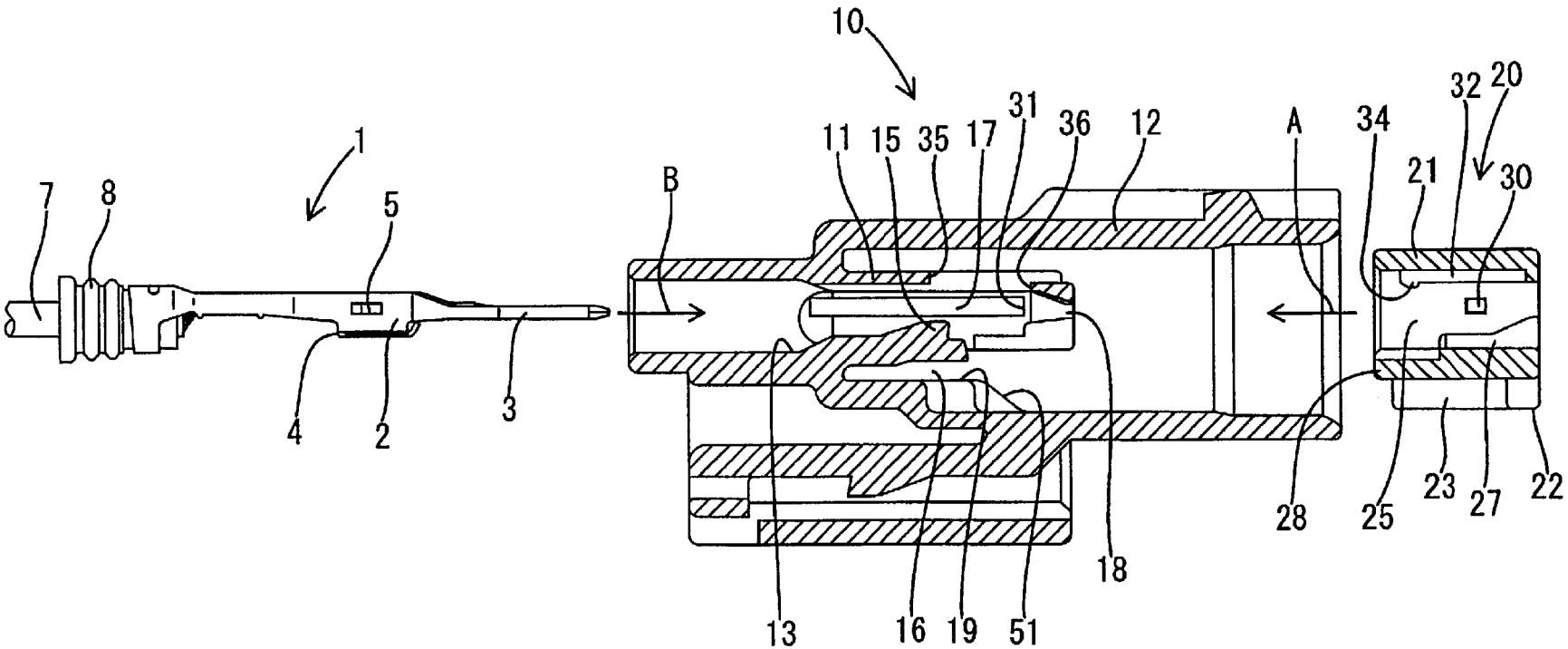
FIG. 2 is an exploded section of the connector.
Figure 4:
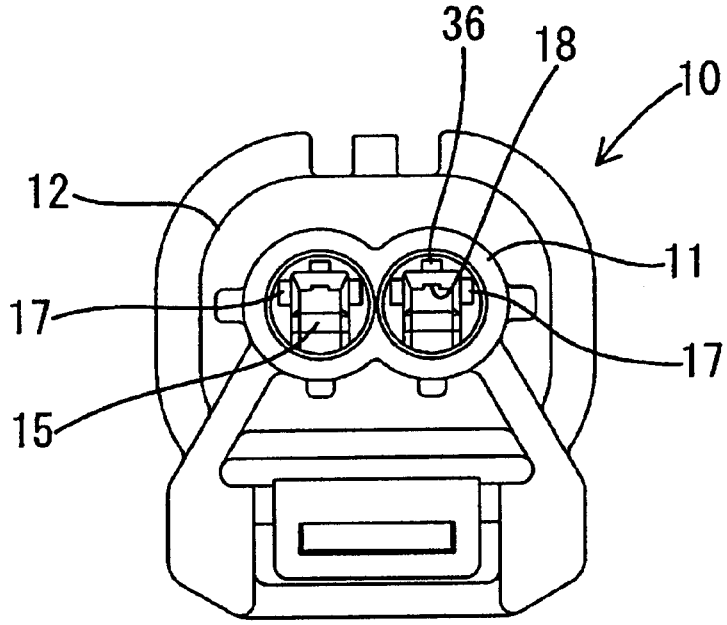
FIG. 4 is a rear view of the male housing.

Guide grooves 17 are formed at the front half of each cavity 13, and extend in forward and backward directions along the left and right side walls of the respective cavity 13, as shown in FIGS. 2 and 4. The guide grooves 17 are dimensioned to receive stabilizers 5 that project from the left and right side surfaces of the male terminal fitting 1. Thus, the stabilizers 5 slide freely along the guide grooves 17 during insertion of the terminals 1 into the cavities 13. The rear ends of the guide grooves 17 are open to communicate with a widened rear half of the cavity 13. However, the front ends of the guide grooves 17 are closed.

The male terminal fitting 1 is connected with an end of a wire 7 e.g. by crimping, and is inserted into the corresponding cavity 13 from behind (from the left side in FIG. 2) while inserting the stabilizers 5 along the guide grooves 17. The male terminal fitting 1 elastically deforms the lock 15 at an intermediate stage of the insertion. However, when the male terminal fitting 1 is pushed to its proper insertion position, the lock 15 is restored substantially to its original position and engages the jaw 4, to achieve primary locking of the male terminal fitting 1 in the cavity 13. At this time, a rubber plug 8 fitted behind the male terminal fitting 1 closes the entrance of the cavity 13, and a tab 3 at the leading end of the male terminal fitting 1 at least partly projects into the receptacle 12 through an insertion hole 18 at the leading end of the cavity 13 (see FIG. 8).

Figure 5:
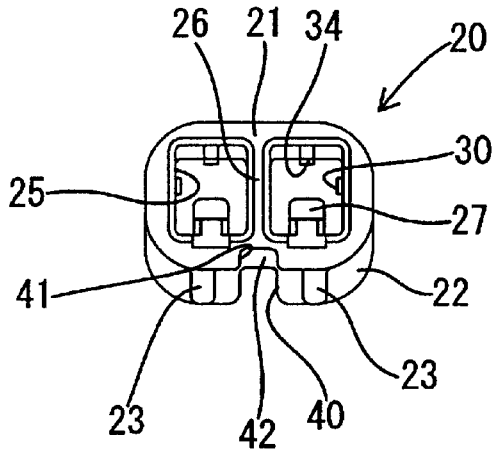
FIG. 5 is a front view of a retainer as a preferred second housing.
Figure 6:
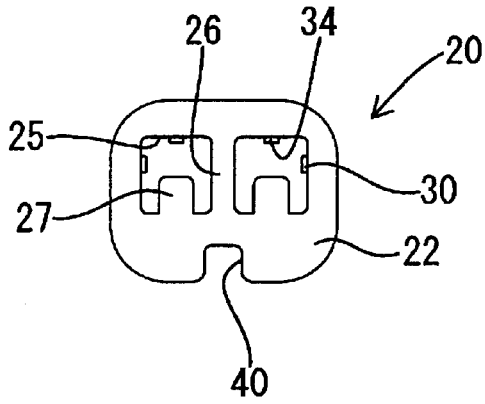
FIG. 6 is a rear view of the retainer.
Figure 7:
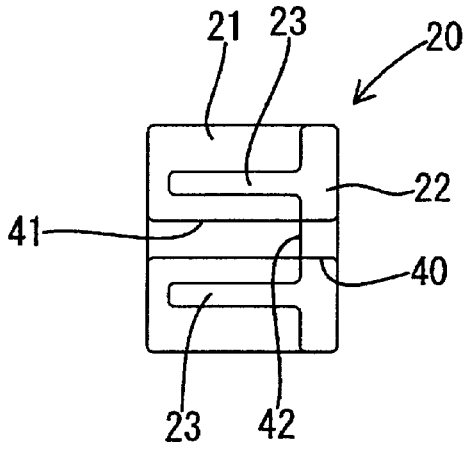
FIG. 7 is a bottom view of the retainer.

The retainer 20 is made of a synthetic resin and has a tubular main body 21 with a front end for insertion into the receptacle 12 and an opposite rear end, as shown in FIGS. 5–7. A bulging portion 22 is formed on the lower surface of the tubular main body 21 and extends forward from the rear end. The retainer 20 is dimensioned to fit into the receptacle 12 and is configured to mount on the front end of the tower 11 to achieve double locking of the male terminal fittings 1 in the cavities 13, as explained below. Left and right ribs 23 for preventing a forcible insertion are formed on the lower surface of the main body 21 and project forward from the bulging portion 22 to a position near the front edge of the retainer 20. A guiding table 19 is formed on a rear lower surface of the receptacle 12, and has width for insertion between the ribs 23. Thus, the lower surface of the main body 21 of the retainer 20 can be slid onto the upper surface of the guiding table 19.

Two engaging holes 25 are formed at opposite sides of a partition wall 26 inside the retainer 20 and are dimensioned to fit around the respective separated sections of the tower 11. A projecting wall 27 is formed at the rear of the bottom wall of each engaging hole 25 with respect to the insertion direction A of the retainer 20 and forms part of the bottom wall of the cavity 13 that will extend from the front end to the insertion hole 18.

The front end of the bottom wall of the retainer 20 defines a thrusting portion 28 that can be inserted into the deformation permitting spaces 16 of the respective locking portions 15.

Full locking projections 30 are formed on the side surfaces of the respective engaging holes 25 distant from each other and in rear-of-center positions with respect to the insertion direction of the retainer 20. The front edges of the guide grooves 17 of the cavities 13 distant from each other define locking edges 31 that engage with the full locking projections 30.

A rib 32 is formed in the widthwise center of the ceiling surface of each engaging hole 25. Each rib 32 extends from the rear end to a position slightly before the front end, and a partial locking projection 34 projects down from the leading end of each rib 32. A groove 35 is formed in the upper surface of each cavity 13 and extends in forward and backward directions from the front end of the cavity 13. The partial locking projection 34 can be slid into a corresponding groove 35. An engaging portion 36 is formed at the front edge of the groove 35 for engagement with the corresponding partial locking portion 34.

Figure 8:
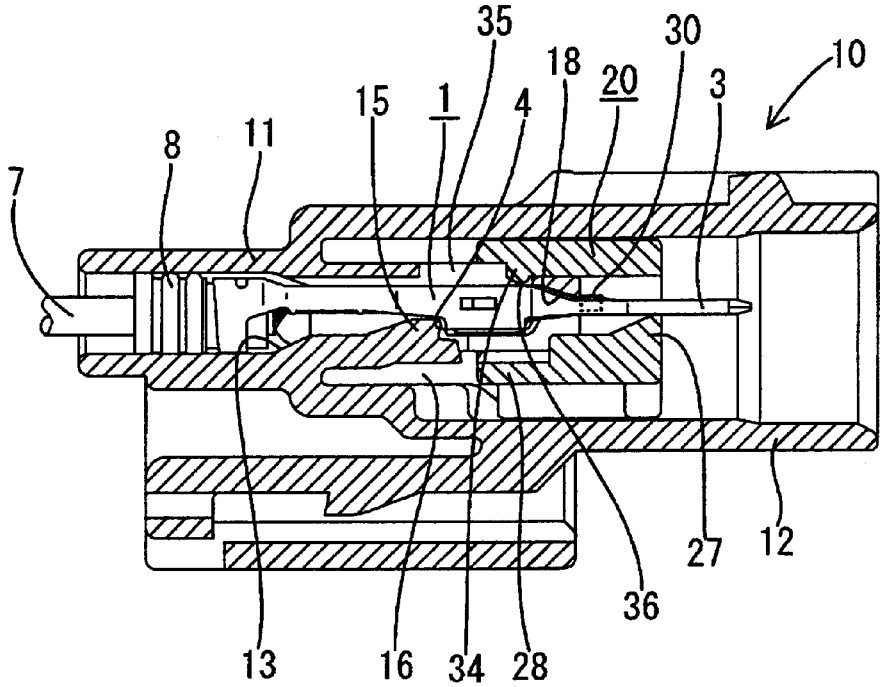
FIG. 8 is a longitudinal section cut along a cavity when the retainer is in its partial locking position.

Insertion of the retainer 20 into the receptacle 12 from the front causes the partial locking projections 34 to engaged with the engaging portions 36 of the grooves 35 and causes the full locking projections 30 to contact the front surface of the tower 11, as shown in FIG. 8. As a result, the retainer 20 is held temporarily in its partial locking position. In this partial locking position, the thrusting portion 28 of the retainer 20 is located before the deformation permitting spaces 16 of the locking portions 15, and thus the locking portions 15 can undergo an elastic deformation.

Figure 9:
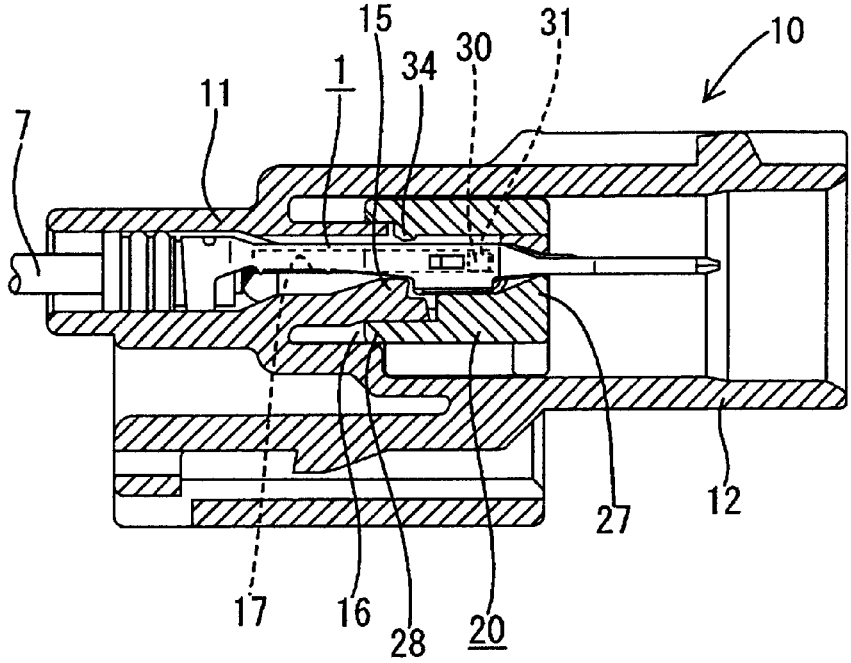
FIG. 9 is a longitudinal section cut along the cavity when the retainer is in its full locking position.

Further pushing of the retainer 20 causes the full locking projections 30 to move over outer side surfaces of the tower 11, into the guide grooves 17, and into engagement with the locking edges 31, as shown in FIG. 9. In this full locking position, the thrusting portion 28 is in the deformation permitting spaces 16 to restrict elastic deformation of the locks 15.

Figure 10:
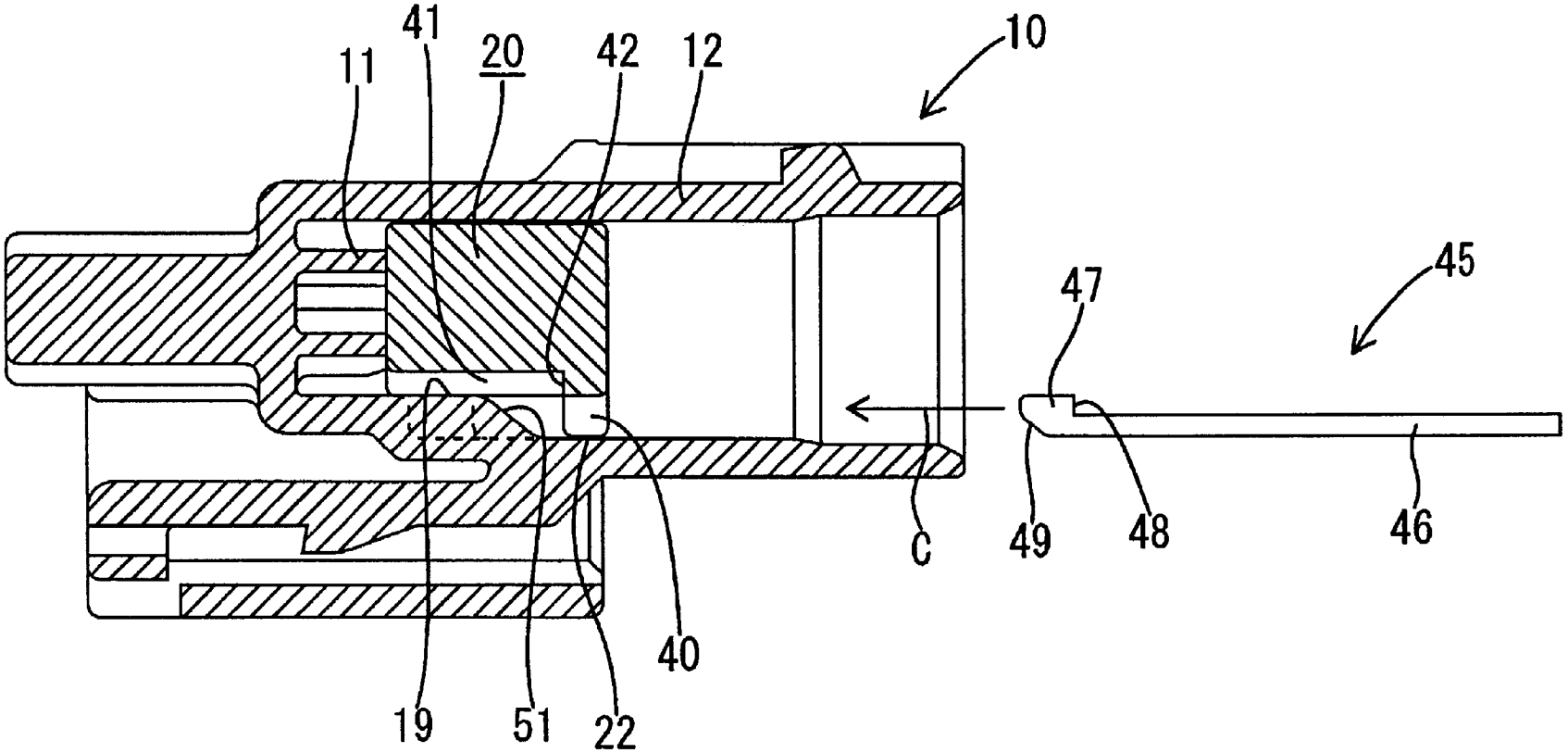
FIG. 10 is a longitudinal section before the retainer is detached.

A jig insertion groove 40 of a specified width is formed substantially in the widthwise center of the bottom end of the bulging portion 22 of the retainer 20. Further, a longitudinal groove 41 of substantially the same width as the jig insertion groove 40 is formed in a corresponding portion of the bottom surface of the main body 21 of the retainer 20 and extends from the front end to a position before the bulging portion 22, as shown in FIG. 10. The rear edge (right end in FIG. 10) of the longitudinal groove 41 acts as a catch surface 42.

A jig 45 used to detach the retainer 20 has a hook 47 at the leading end of a narrow handle 46, as shown in FIG. 10, and has a width to permit at least partial insertion into the jig insertion groove 40. The hook 47 has a rearwardly facing vertical surface 48 that is substantially normal to the longitudinal direction of the narrow handle 46 and that is engageable with the catch surface 42. A lower slanted surface 49 is formed at the leading end of the hook 47.

A guide surface 51 is at the lower rear of the receptacle 12 and projects substantially in the middle of the front surface of the guiding table 19. The guide surface has substantially the same width as the jig insertion groove 40 and the longitudinal groove 41 and is sloped upwardly to reach the upper surface of the guiding table 19.

The connector is assembled by first inserting the retainer 20 into the receptacle 12 of the male housing 10 from the front, as shown by an arrow A of FIG. 2, so that the retainer 20 is held in the partial locking position shown in FIG. 8. In this state, the locks 15 are elastically deformable toward the deformation permitting spaces 16. Next, as shown by an arrow B of FIG. 2, the male terminal fitting 1 is inserted into the corresponding cavity 13 from behind and is pushed to deform the lock 15 elastically toward the deformation permitting space 16. When the male terminal fitting 1 is pushed to its proper insertion position, the lock 15 is restored elastically substantially to its original position to engage the jaw 4, as shown in FIG. 8. As a result, the male terminal fitting 1 achieves primary locking and does not come out of the cavity 13.

Subsequently, the retainer 20 is pushed toward the full locking position shown in FIG. 9. As a result, the full locking projections 30 engage the locking edges 31 of the guide grooves 17 to lock the retainer 20. As the retainer 20 is pushed, the thrusting portion 28 of the retainer 20 enters the deformation permitting spaces 16, thereby preventing the locks 15 from being inadvertently elastically deformed. In this way, the male terminal fittings 1 are locked doubly and do not come out of the cavities 13. With the retainer 20 locked in the full locking position, the catch surface 42 on the retainer 20 is located slightly before the guide surface 51, as shown in FIG. 10.

When the retainer 20 is locked fully, a mating female connector housing (not shown) that accommodates female terminal fittings is fitted into the receptacle of the male housing 10 and achieves an airtight fit via a seal ring to connect the corresponding female and male terminal fittings.

Figure 11:
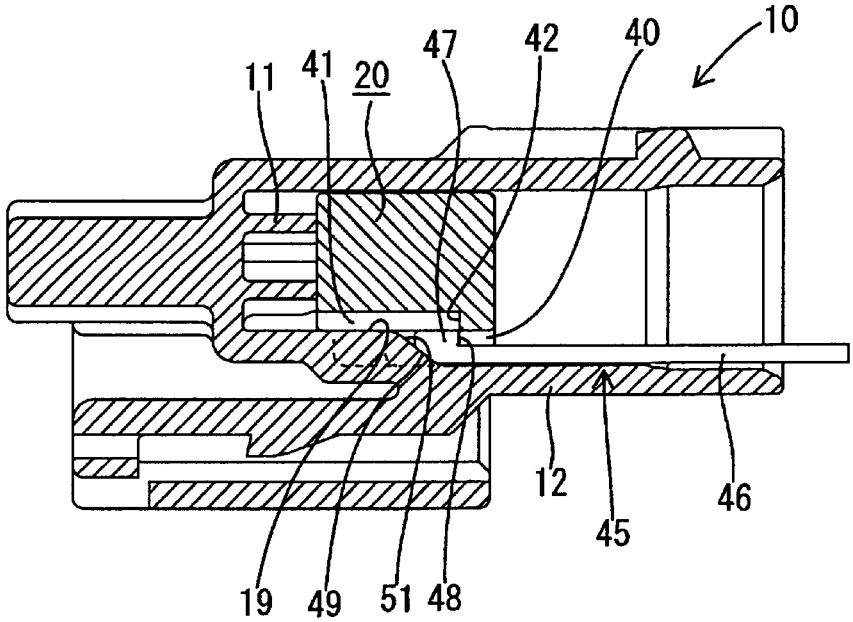
FIG. 11 is a longitudinal section showing an inserted state of a jig.

The male terminal fittings 1 can be withdrawn from the male housing 10 if necessary for maintenance or other reason. The withdrawal of the male terminal fittings 1 is achieved by first pulling the mating female housing out of the receptacle 12 of the male housing 10. Then, the jig 45 for detaching the retainer 20 is inserted along the center portion of the inner surface of the bottom wall of the receptacle, as shown by an arrow C of FIG. 10 to insert the hook 47 into the jig insertion groove 40 of the retainer 20. When the hook 47 passes the jig insertion groove 40, the slanted surface 49 of the hook 47 contacts the guide surface 51 as shown in FIG. 11. The jig 45 subsequently is pushed, and the hook 47 moves up along the guide surface 51 to enter the longitudinal groove 41. Upward movement of the jig 45 stops when the leading end of the handle 46 contacts the ceiling surface of the jig insertion groove 40. At this time, the vertical surface 48 of the hook 47 is opposed to the catch surface 42 in a position slightly before the catch surface 42.

Figure 12:
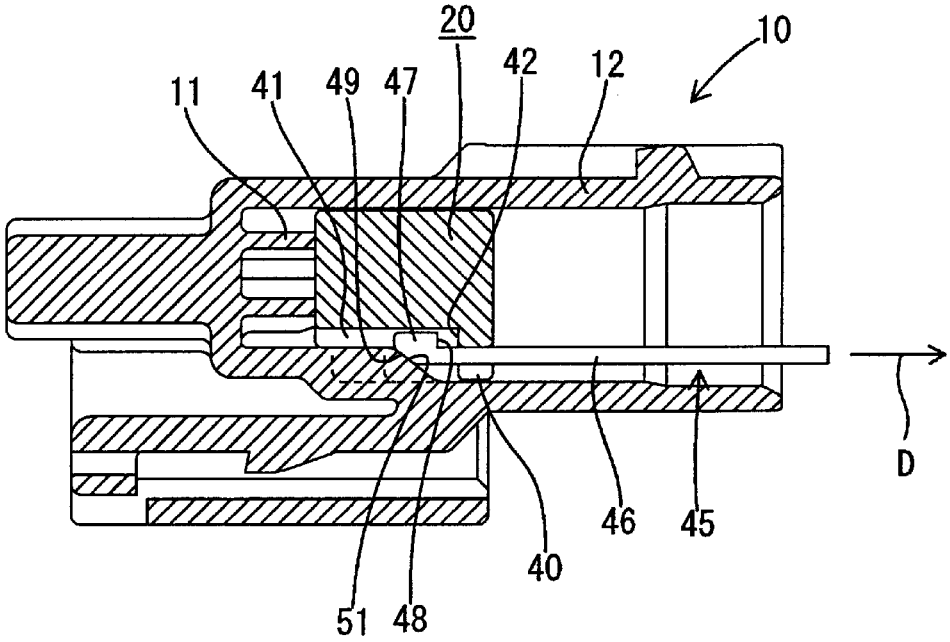
FIG. 12 is a longitudinal section showing a guided state of the jig.

The jig 45 then is gripped by the handle 46 and pulled back, as shown by an arrow D in FIG.12. The vertical surface 48 of the hook 47 then contacts the catch surface 42 and exerts a backward pulling force on the retainer 20 to disengage the full locking projections from the locking edges 31 and to disengage the partial locking projections 34 from the engaging portions 36. Consequently, the retainer 12 can be pulled out of the receptacle 12.

After the retainer 12 is detached, the locks 15 of the respective cavities 13 are exposed to the front. Thus, an unillustrated jig for unlocking the lock 15 can be inserted into the receptacle 12 from front to deform the locking portion 15 elastically toward the deformation permitting space 16. The unlocked male terminal fitting 1 then can be withdrawn backward from the cavity 13 by holding and pulling the wire 7.

The retainer 20 can be mounted again in its partial locking position after the male terminal fittings 1 are withdrawn, and hence there is no likelihood of losing the retainer 20. The male terminal fittings 1 can be mounted again in accordance with the aforementioned procedure.

As described above, the hook 47 is guided automatically by the guide surface 51 to a position where it engages the catch surface 42 of the retainer 20 merely by pushing the jig 45 through the jig insertion groove 40 of the retainer 40. The retainer 20 then can be detached by pulling the jig 45.

An operation of engaging the jig 45 with the catch surface 42 and an operation of detaching the retainer 20 can be performed smoothly. Further, it is not necessary to move the jig 45 to obtain a good catch timing. Therefore, the inner surface of the receptacle 12 and the retainer 20 will be neither scratched nor deformed.

The present invention is not limited to the above described and illustrated embodiments. For example, the following embodiments are also embraced by the technical scope of the present invention. Beside the following embodiments, various changes can be made without departing the sprit of the present invention.

The mechanism for locking the retainer in its partial locking position and full locking position may be unlocked elastically by providing at least one elastic locking or latching arm on one of the retainer and the housing and by providing at least one corresponding projection on the other of the retainer and the housing. The locking arm and the corresponding projection are engageable with each other for locking or positioning the retainer in the partial and/or full locking position.

The present invention is widely applicable to connectors of the type assembled by connecting two separate housings and split connectors in which auxiliary housings are fitted into a frame, i.e. connectors in general in which one housing is connected with another housing by inserting the one housing into a mounting recess of the other housing.

What is claimed is:

1. A connector comprising:

a housing with opposed front and rear ends and a receptacle formed in the front end, a tower projecting in a forward direction into the receptacle, the tower being formed with at least one cavity for receiving a terminal fitting, the tower further comprising a lock adjacent the cavity for achieving primary locking of the terminal fitting in the cavity, a deformation permitting space defined in the receptacle adjacent the lock for permitting resilient deflection of the lock away from the cavity;

a retainer having front and rear ends, the front end of the retainer being insertable into the receptacle and releasably lockable over the tower, a portion of the front end of the retainer being inserted in the deformation permitting space when the retainer is releasably locked on the tower, a jig insertion groove forward of the rear end of the retainer, a bulging wall between the jig insertion groove and the rear end of the retainer, the bulging wall having a catch surface in the jig insertion groove and facing the front end of the retainer; and a jig guide formed in the housing and configured for guiding a jig into position for engaging the catch surface such that the jig can pull the retainer from the receptacle, the jig guide being slanted at an acute angle relative to an insertion direction of the retainer into the receptacle of the connector housing.

2. The connector of claim 1, further comprising a temporarily holding means for holding the retainer in a position (FIG. 8) on the housing that permits deformation of the lock.

3. The connector of claim 1, wherein the housing comprises a retainer guide for guiding the retainer into the housing, wherein the jig guide is substantially continuous with the retainer guide.

* * * * *